US006045373A

United States Patent [19]

Hardt

[11] Patent Number: 6,045,373

[45] Date of Patent: Apr. 4, 2000

[54] CONNECTION TERMINAL, IN PARTICULAR FOR CONNECTING BRANCH CONDUITS TO ELECTRIC MAINS, AS WELL AS CONTACT ELEMENT FOR IT

[75] Inventor: Falk Hardt, Kondradsreuth, Germany

[73] Assignee: Gerhard Petri GmbH & Co., Hof/Saale, Germany

[21] Appl. No.: 08/733,980

[22] Filed: Oct. 18, 1996

[30] Foreign Application Priority Data

Oct. 20, 1995 [DE] Germany ..... 195 39 184

[51] Int. Cl.[7] ..... H01R 4/66

[52] U.S. Cl. ..... 439/98; 439/425

[58] Field of Search ..... 439/92, 98, 100, 439/439, 440, 441, 425

[56] References Cited

U.S. PATENT DOCUMENTS

| | | | |
|---|---|---|---|
| 2,395,373 | 2/1946 | Johnson | 439/425 |
| 3,875,325 | 4/1975 | Anderson et al. | 439/98 |
| 3,937,548 | 2/1976 | Dittmann | 339/95 D |
| 4,080,024 | 3/1978 | Kroon | 439/98 |
| 4,479,692 | 10/1984 | Greenwood et al. | 439/92 |
| 4,527,854 | 7/1985 | Sprick | 439/418 |
| 4,722,579 | 2/1988 | Cummings et al. | 439/439 |

FOREIGN PATENT DOCUMENTS

| | | |
|---|---|---|
| E 6868 | 11/1956 | Germany . |
| 2 227 211 | 1/1974 | Germany . |
| 33 30 630 | 10/1984 | Germany . |
| 23 44 404 | 3/1995 | Germany . |
| 1 302 158 | 1/1973 | United Kingdom . |

*Primary Examiner*—Gary F. Paumen
*Assistant Examiner*—Tho D. Ta
*Attorney, Agent, or Firm*—Gardner, Carton & Douglas

[57] ABSTRACT

The present invention relates to a connection terminal for connecting branch conduits to electric mains, preferably a ground lead. The connection terminal includes clamping elements which may be applied around the electric main, a contact element for establishing an electric contact between the electric main and the branch conduit, and a clamping device for clamping the clamping elements to each other and to the electric main in a safe position. The contact element includes an opening for inserting the branch conduit and a spring element having spring devices which are deformable by the branch conduit during insertion and which retain the position of the branch conduit as well as establish an electric contact between the contact element and branch conduit.

24 Claims, 4 Drawing Sheets

CONNECTION TERMINAL, IN PARTICULAR FOR CONNECTING BRANCH CONDUITS TO ELECTRIC MAINS, AS WELL AS CONTACT ELEMENT FOR IT

SUMMARY OF THE INVENTION

The present invention relates to a connection terminal, in particular for connecting branch conduits to electric mains of an earth lead, according to the generic term of claim 1.

In addition the present invention relates to a contact element for the use in a clamping element of a connection terminal, in particlar for the connection of at least one branch conduit to an electric main.

Such connection terminals serve for connecting in particular a house service connection to an electric main, embedded in the ground. For this purpose a branch conduit has to be connected to an electric main, however, the electric main as such must not be disconnected, i.e. a separation of the electric main and the insertion of a connection part for branching off the branch conduits is prohibited in accordance with the relevant regulations.

For this reason connection terminals had been developed so far, having at least two clamping elements, being arranged around the electric main and enclosing it.

For establishing an electric contact between the insulated electric main and a branch conduit, the insulation surrounding the multiwire electric main is removed in the area of the connection terminal, such that the wires of the multiwire electric main, also insulated for their part, are open. For establishing an electric contact between the individual wires of the electric main and the relevant branch conduits, adequate contacts are provided; for establishing the contact, the clamping elements have to be clamped adequately at the electric main, being performed by means of a firm clamping device.

Usually the connection terminal consists of two half-shell clamping elements with two contact elements each, such that four branch conduits may be connected with four different wires of an electric main.

The half-shell clamping elements provided are quite expensive and the fitting is very time-consuming, as an adequate aimed penetration of separation elements between the wires of the multiwire electric main and a feeding to the contact elements is required.

In addition the halfshells are tightened each on their contact surfaces by means of screws, which have to be screwed through face-side flanges of the halfshells.

A disadvantageous, correspondingly long mounting time of such halfshell connection terminals is required.

In addition three-piece connection terminals are known, having in each piece a contact element, having adequate contacts for insertion into the electric main. The design, in particular of the face sides of the clamping elements coming into contact, and their screw connection with each other corresponds to that of the halfshell connection terminals.

Furthermore a disadvantage of the connection terminals and/or contact elements as are state of the art, is the fact that the position securing of the branch conduit in the connection terminal is performed by clamping screws; on the one hand this requires an increased assembly effort, on the other hand defined tightening moments have to be guaranteed, such that the branch conduit(s) are defined and clamped correctly.

Usually this might be performed by screws, in particular tear-off cap screws or the like, however these components are especially expensive and require careful handling during assembly.

Furthermore in case of the halfshell design of a connection terminal, being adapted to four-wire leads of an electric main, the disadvantage arises that these are exclusively suitable for four-wire electric mains, and in addition these must have identical cross sections each.

The present invention is therefore based upon the task to improve a connection terminal of the above mentioned kind in such a way, that it may be used universally and it should permit an especially simple fixation of the branch conduit(s) in the connection terminal.

Furthermore the present invention is based upon the task to create an adequate contact element, suited for the use in a clamping element of a connection terminal, in particular for the connection of at least one branch conduit to an electric main and may thus be used universally.

The solution of these tasks is given in the features of claim 1 and/or 27.

As provided for by this invention the contact element of the connection terminal has at least one spring element, having a spring device, which may be deformed by the branch conduit during insertion, providing a position retention of the branch conduit as well as an electric contact between contact element and branch conduit.

As provided for by this invention it will be thus possible to secure the position of the branch conduit in the contact element, simply by putting it into the adequate opening of the contact element, thus avoiding additional expensive screw connections and clampings of the branch conduit by means of screws.

The spring element used in the connection terminal as provided for by this invention is able to provide the position retention force required for the branch conduit, providing in addition a good electric contact, due to the deformed sections of the contact element, thus guaranteeing that they are positioned adjacent to each other.

The same advantages are given in case of the contact element as provided for by this invention, and the additional advantage is given that it may be used universally for connection terminals, as well as for any kind of connection terminals, being used for the electric connection of two leads.

This especially includes multiwire leads as well as electric mains and branch conduits.

Further advantages of the connection terminal and/or of the contact element as provided for by this invention are stated in the relevant subclaims.

As an advantage the contact element arranged in the connection terminal has at least two, preferably three spring elements, having fundamentally the same design, being arranged at small distances to each other in the opening of the contact element, the spring elements forming a set. Thus it is achieved that an adequate safe fixation of the branch conduit in the opening is guaranteed and a safe contact point for transferring electric current will be created in addition.

Furthermore it is advantageous that the formation of a set of spring elements results in a correspondingly simpler pre-assembly.

In case the contact element has at least two spring elements, suitable for branch conduits of different cross-sectional dimensions, a univeral usability of the contact element and thus of the connection terminal is provided. E.g. by providing various diameters the branch conduits of various diameters may be held by one type of connection terminal.

Furthermore, in the opening of the contact element also several spring element sets may be arranged at a distance, each spring element set being provided for a predetermined cross section and/or a predetermined cross section size of the branch conduit. Thus the advantages of the universal applicability of the connection terminal are interlinked with the advantage of good position retention and contact connection.

By a ring-shaped design of the spring elements, a particularly simple and space-saving embodiment of the spring elements is provided, supporting again the special advantage of the small size of the total connection terminal.

Furthermore the ring-shaped spring element has an advantageous design, i.e. notches coming from the internal border of the ring-shaped spring element are provided, extending in the direction of the external border of the spring element, one of the spring devices being formed between two adjacent notches.

By means of these spring tongues created, the advantage results that the branch conduit's surface is scratched and/or torn open during insertion and the oxide film on e.g. aluminum leads will be destroyed. This results in a safe creation of an electric contact connection.

As an advantage an even higher compactness of the connection terminal is achieved by the fact that the contact element has two openings for receiving two branch conduits. Thus one connection terminal serves for creating two branch conduits for two different houses.

The axes of the openings may conincide, as an advantage the axis or the axes also run parallel to the axis of the electric main in the connection terminal.

Of course it is possible to arrange the openings differently, e.g. vertical or angular to the axis of the electric main, crossing the connection terminal.

In case a separation wall is provided between the openings, this serves preferably as limit stop for the branch conduit, if this is inserted into the opening.

The same applies to the above mentioned different spring elements and/or spring element sets or it is at least similar to it, the openings (e.g.) of the spring elements tapering in the direction of the limit of the opening and/or separation wall. This means that the smallest branch conduit will be received by the innermost spring element and the largest branch conduit will be received by the spring element being closest to the entrance opening.

As an advantage the contact element has dentiform contacts on the side pointing towards the main, its tips serving as a contact to the electric main.

This is performed such that the teeth penetrate the insulating case of the relevant lead and/or the relevant wire of the multiwire electric main and subsequently come into contact with the wire(s) of the leads of the electric main.

As an advantage the teeth are arranged in several rows next to each other.

In a particularly simple embodiment, the contact element may be designed as a sleeve.

Connection terminals, in particlar those buried in the ground, have to be permanently protected against the penetration of dirt and humidity, thus guaranteeing a permanent electric connection. For this reason the clamping element has at least one hollow, opening to the inside in the direction to the main, for receiving the contact element. This is achieved by sealing the contact element completely as to the external of the connection terminal, thus preventing humidity and dirt from entering.

As an advantage the connection terminal is composed of several clamping elements, being designed in sectors.

Depending on the kind of main, adequate sectors are formed. In case of a four-wire main, having in principle four wires of identical size, a connection terminal with four clamping elements is formed, which may be identical in design. As an advantage this results in a simplification of the clamping element production.

However, electric mains are increasingly used having wires of different sizes. E.g. an electric main is used, having three wires in sector-shape with an angle of more than 90° and a fourth wire as neutral conductor is situated on the remaining fourth sector, this lead may also be provided as round wire.

The clamping elements are designed accordingly, i.e. three clamping elements with larger sector dimensions and a clamping element with a smaller sector are used.

As an advantage the clamping elements are designed in the shape of a circular segment (FIGS. 3 and 5).

In case of four clamping elements having the same size, a circular sector angle $\alpha$ of 90° each per clamping element results.

In case of a so-called three-and-a-half-wire electric main, three clamping elements with an adequate sector angle $\alpha$ are formed and the fourth, smaller clamping element has a correspondingly smaller sector angle.

For a further sealing of the electric connection points of the contact element and/or clamping element and the main, a sealant, preferably a sealing tape (FIGS. 3 to 5) is provided, extending between the internal circumferential side of the contact element and the electric main.

Accordingly even the opening of the contact element, into which the branch conduit is inserted, will be sealed to the external side.

For stiffening the clamping element on the one hand and for saving material in the clamping element on the other hand, it is designed as rib-like body with deepenings accessible from the outside. Thus a sufficient strength of the clamping element is achieved when pressing it to the electric main on the one hand and when pressing it to the adjacent clamping elements on the other hand.

As an advantage the clamping element is provided with a wedge protruding in the direction of the main, permitting the wedge to be inserted between two wires of the main when applying the clamping element; thus a first fixation of the loose clamping element at the main is achieved.

As an advantage the wedge is divided into two partial wedges having a certain distance to each other, being arranged in axial end areas of the clamping element, such that an adequate free space is provided in between for inserting the contact element into the clamping element.

Again above all for sealing reasons, the clamping element has one, preferably two areas extending in the opposite direction of the axial direction, tapering in cross section, these areas extending from the face sides of the clamping elements.

As an advantage the projecting parts are made as one piece with the clamping element, such that the clamping element may be manufactured e.g. as injection moulded part.

The clamping device for clamping the claming elments among each other and to the electric main is preferably designed as pipe clamp, which may be laid in a simple way around the clamping elements.

The pipe clamp may be designed as a band, having a screw-shaped tightening element, applying an adequate tightening moment to the clamping elements by screws.

In order to generate a defined tightening moment and thus a clearly defined clamping force of the connection terminal on the electric main, the screw of the screw-shaped tightening element is designed as tear-off cap screw. As soon as an adequate tightening moment is reached, the cap of this screw is torn off, resulting in addition in a particularly simple and safe assembly of the connection terminal.

The present invention also relates to a contact element for the use in a clamping element of a connection terminal, in particular for the connection of at least one branch conduit to a main. For this purpose the contact element has at least one opening for inserting the branch conduit and contacts for establishing the electric connection between the electric main and at least one branch conduit. As provided for by this invention the contact element has at least one spring element, into which the branch conduit may be inserted and its position is thus guaranteed. Furthermore this spring element guarantees and adequate electric contact.

In addition the contact element, as already detailed above, may have several spring elements and/or one or several sets of different or even identical spring elements.

Further details, features and advantages of the present invention may be taken from the subsequent description of preferred embodiment examples of the connection terminal and/or contact element as provided for by this invention, with reference to the figures.

Subsequently the construction of the connection terminal as provided for by this invention is described with reference to the figures.

DETAILED DESCRIPTION OF THE INVENTION

Figure 1:
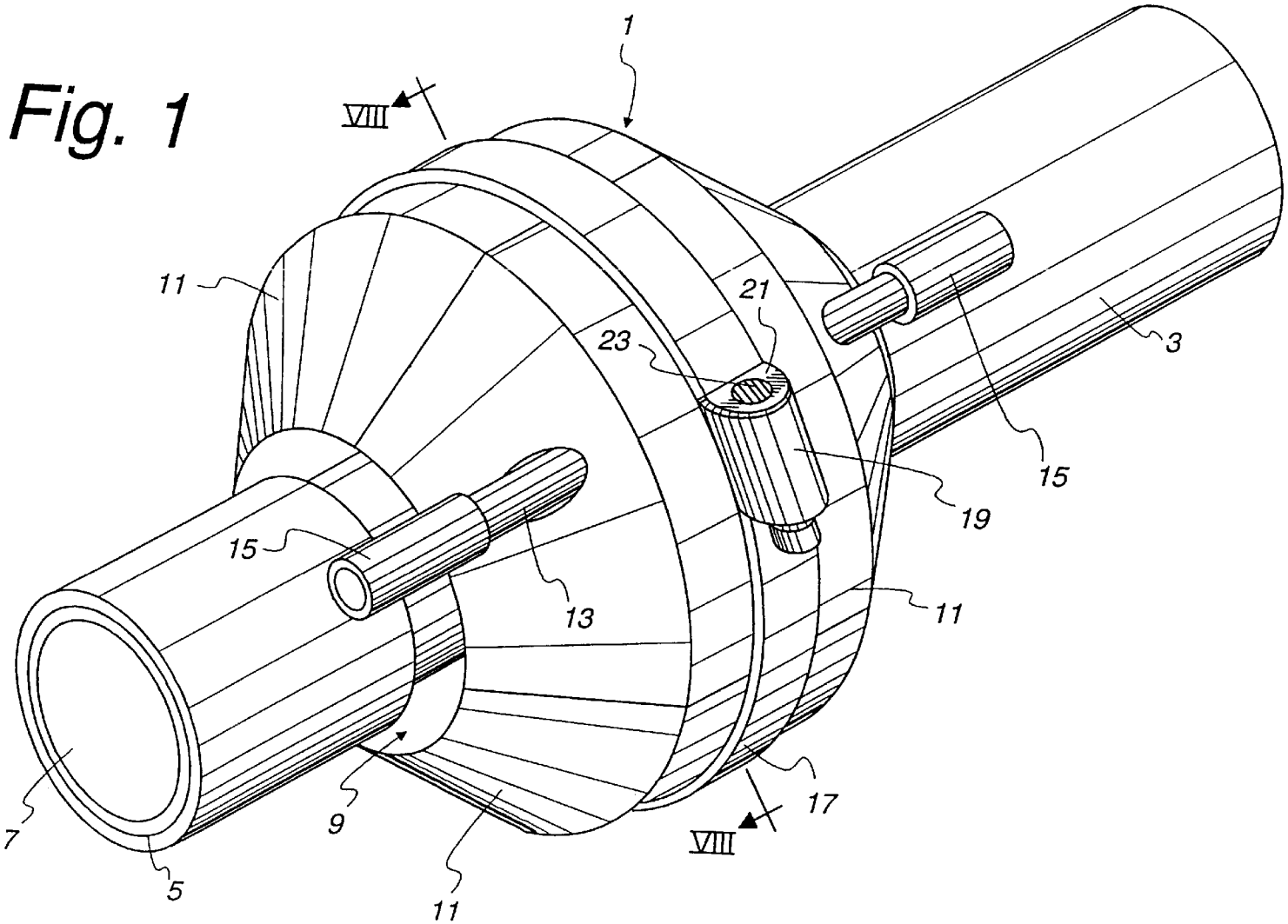
FIG. 1 shows a perspective view of a connection terminal s provided for by this invention, mounted to an electric main.

FIG. 1 gives a perspective schematic representation of a connection terminal 1, arranged around an electric main 3. The electric main 3 has an insulating case 5, surrounding a multi-wire cable loom 7. In the present schematic example the cable loom 7 consists of four wires.

In area 9 of the connection terminal the electric main 3 is freed from its insulating case, resulting in a tapering of the cross section of the electric main 3.

Area 9 is surrounded by connection terminal 1, having four clamping elements 11, three of which are visible in FIG. 1.

In order to simplify the drawing only one clamping element 11 is depicted, having openings 13, into which one branch conduit 15 each is inserted. The other clamping elements 11 also have openings for branch conduit 15.

The four sector-shaped clamping elements 11 are surrounded by a band-shaped pipe clamp 17, having a screw-shaped tightening element 19.

In the assembled condition of the connection terminal as shown in FIG. 1, a tear-off cap screw 21 is visible, the tear-off cap being already removed and only the relevant fracture surface 23 is visible.

Figure 2:
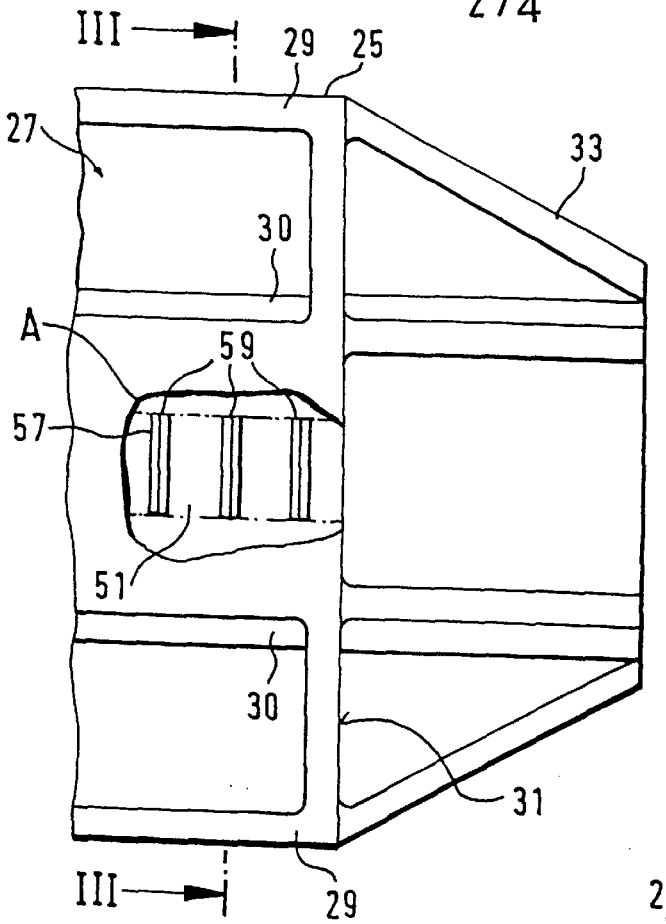
FIG. 2 shows a partly open partial view of a clamping element of the connection terminal as provided for by this invention.

As shown in FIG. 1, the clamping elements 11 have smooth external surfaces, whereas in an alternative embodiment according to FIG. 2 a clamping element 25 is shown, having rib-shaped structures with deepening or hollows 27 open to the outside. Ribs 29 and 30 limit these hollows 27.

As may also be seen in FIG. 2, the clamping element 25 has on its face side 31 a projecting area 33, tapering in cross section, the tapering leading in the direction of the external side and/or in axis direction of clamping element 25.

Here too, a rib structure is kept and the projecting area 33 is connected with the clamping element 25 as one piece.

Figure 6:
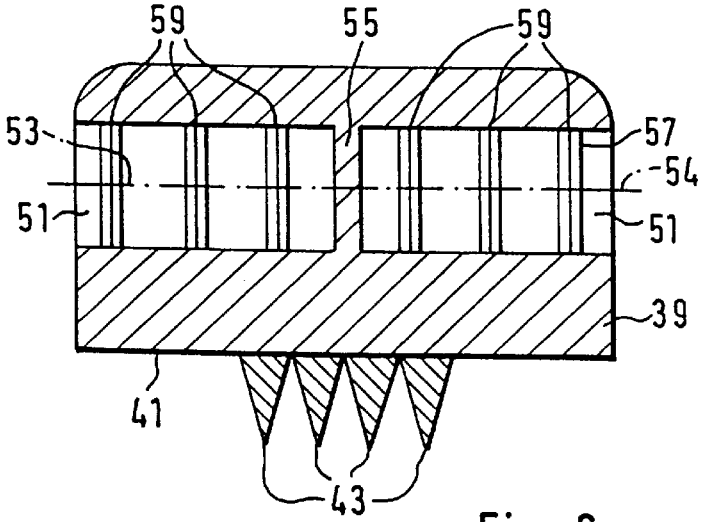
FIG. 6 shows a sectional view according to line VI—VI of FIG. 5 of the contact element.

The partially sectional section A is described in FIG. 6.

Figure 3:
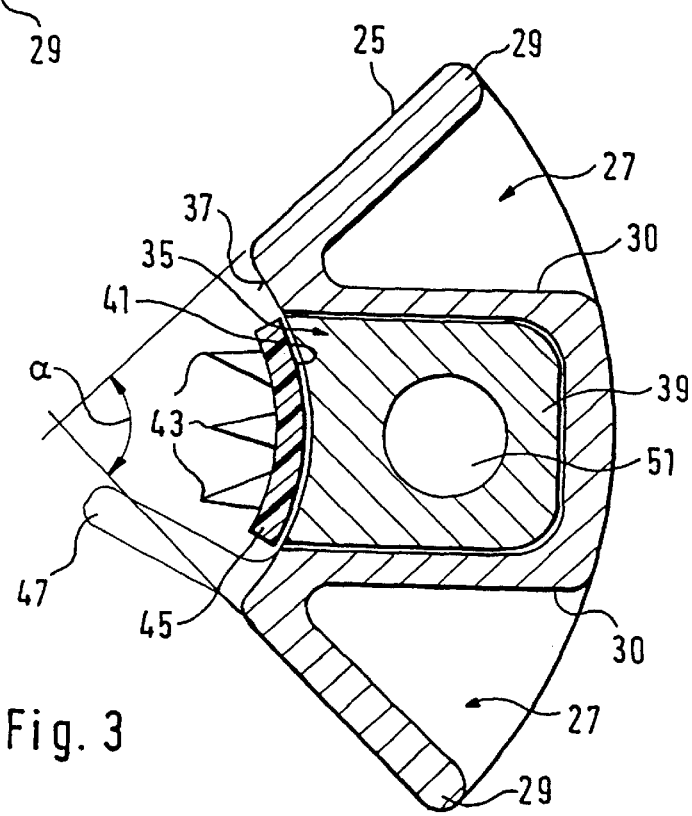
FIG. 3 shows a sectional view according to line III—III of FIG. 2.

FIG. 3 shows a sectional view according to the line III—III of FIG. 2. This sectional view clearly shows the construction of clamping element 25, being identical to the construction of clamping element 11 with the exception of the external contour. For clarity reasons the representation of the spring element is deleted here and depicted in FIG. 5.

In clamping element 25 a hollow 35 is formed, being open from the inside 37 of the clamping element 25.

In this hollow 35 a contact element 39 is inserted, being designed such that it follows the contour of hollow 35 on the one hand and the internal side 37 of clamping element 25 on the other hand.

On the inside turned towards the electric main or on the bottom side 41 of the contact element 39 dentiform contacts 43 are provided, tapering off towards the electric main.

On the bottom side 41 of the contact element 39 a band-shaped sealing agent 45 is provided.

Furthermore the clamping element 25 has a wedge 47, serving as a first position retention of clamping element 25 on the electric main.

Figure 4:
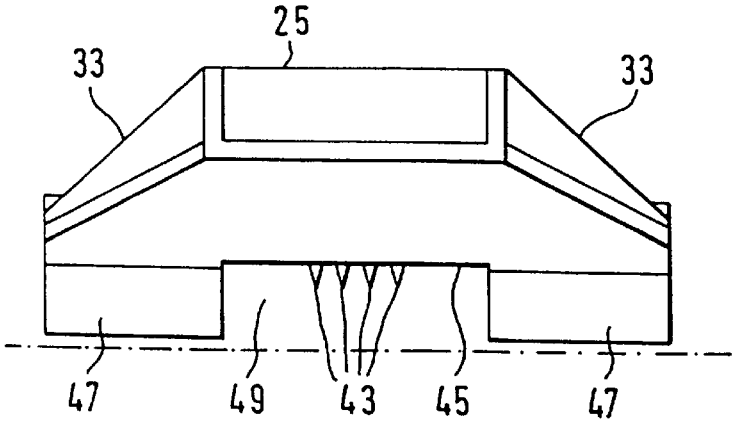
FIG. 4 shows a side view onto the clamping element of the connection terminal as provided for by this invention, in a reduced representation.

FIG. 4 gives a reduced schematic representation of a clamping element 25 with two projecting areas 33. Here the clamping element 25 has two partial wedges 47, being arranged at the relevant end areas of clamping element 25. There is a free space 49 in between, serving in particular for inserting the contact element 39 from below into hollow 35 of the clamping element 25.

Again the band-shaped sealing agent 45 is visible and when looking also at FIG. 3, it may be seen that the dentiform contacts 43 are arranged in three rows of four teeth each.

Of course, other teeth configurations or arrangements are possible within the scope of this invention.

Figure 5:
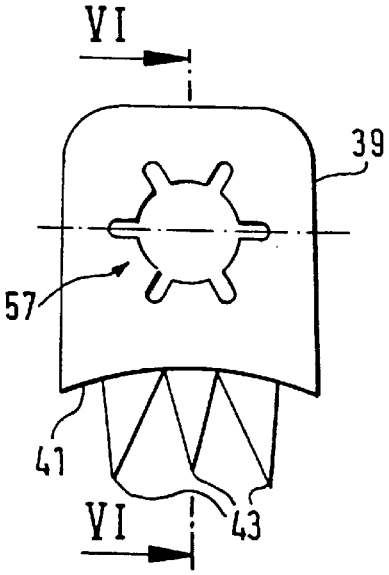
FIG. 5 shows a side view of a contact element.

FIG. 5 shows an insulated contact element 39 as provided for by this invention, as depicted in FIG. 3 as a part inserted into clamping element 25. FIG. 5 shows an opening 51 on the face side, being further detailed with reference to FIG. 6.

FIG. 6 shows a sectional view of contact element 39, as provided for by this invention, in accordance with line VI—VI of FIG. 5.

As may be seen in FIG. 6, the contact element 39 has a symmetrical design with two openings 51, whose axes 53 and 54 coincide in this embodiment.

Between the openings 51 a separation wall 55 is formed, which may serve as limit stop for a branch conduit.

Figure 7:
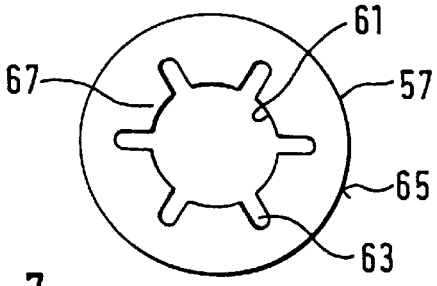
FIG. 7 gives a top view of a spring element of the contact element.
Figure 8:
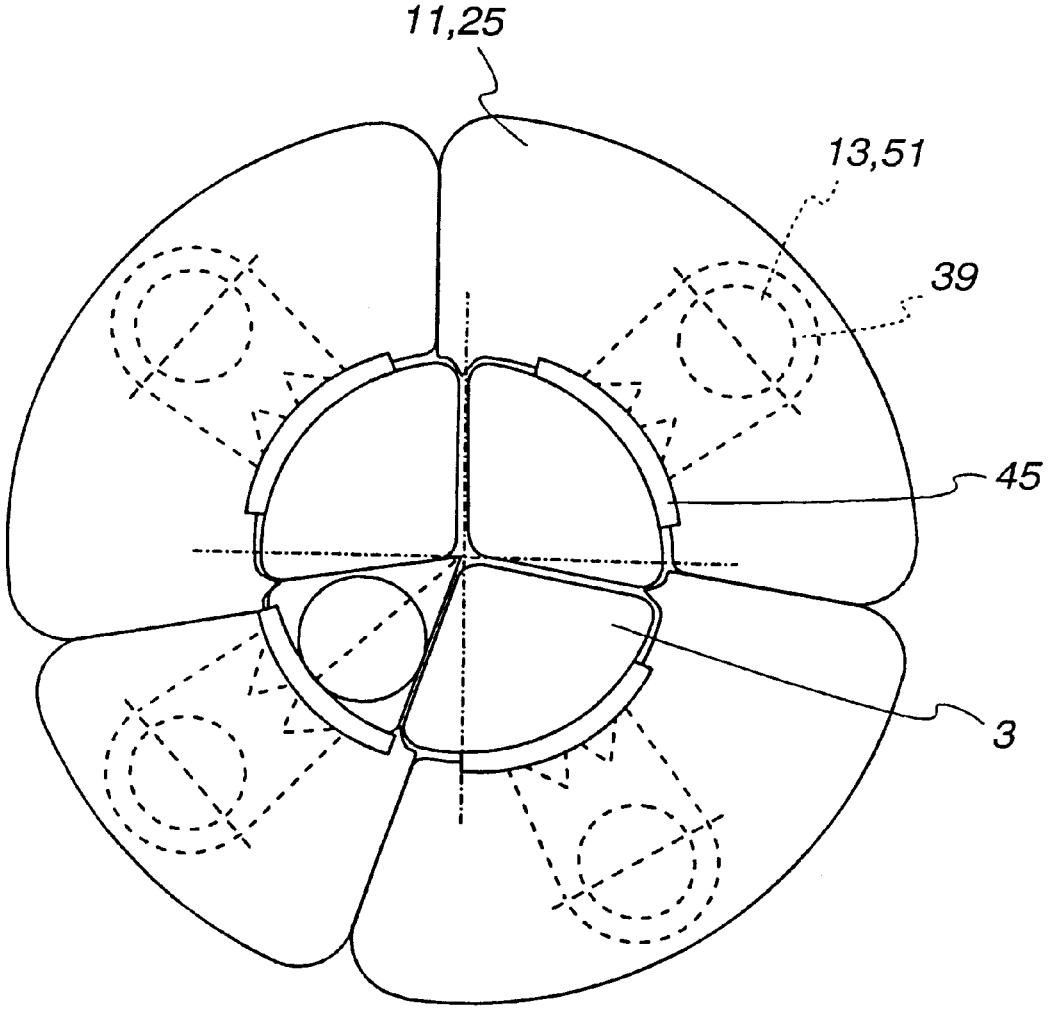
FIG. 8 shows a cross-sectional view of an embodiment of the present invention along the line VIII—VIII in FIG. 1.

For fixing the branch conduit 15 in opening 51 and/or 13 (FIG. 1) spring elements 57 are provided, one being depicted in FIG. 7 in top view.

As may be seen in FIG. 6, in each opening 51 three sets 59 of spring elements 57 are arranged.

As may be seen in FIG. 7, the spring element 57 is designed as a ring, notches 63 running from the internal border 61 to the external border 65, forming bendable spring devices having the shape of tongues.

Subsequently the function of the connection terminal and/or contact element as provided for by the invention is described.

For fixing the connection terminal to the electric main, at first the insulating case 5 is removed in area 9 of the connection terminals 1, such that the relevant insulated leads of the multi-wire main 3 become accessible from outside.

One sector-shaped clamping element 11 and/or 25 after the other is inserted between the two wires of the electric main 3 by means of wedge 47 and is at first secured in position.

If all—in this case four—clamping elements 11 are located at the electric main 3, the band-shaped pipe clamp 17 is laid around the clamping elements 11 and tightened by means of tear-off cap screw 21.

Here the dentiform contacts 43 penetrate the insulating case of each wire, cut it through and contact the real metallic lead of the relevant wire.

After applying a predetermined torque the tear-off cap of the tear-off cap screw 21 is torn off and the connection terminal 1 is firmly mounted on the electric main 3.

Now the branch conduit 15 is inserted into the opening 13 and/or 51 and penetrates one or more spring element sets 59. In this way the spring tongues 67 deform and slide on the surface of the branch conduit 15 in such a way that the oxide layer on it is cut and an electric contact is established. At the same time the spring devices 67 get clamped on the branch conduit and they prevent that it may be pulled out again of the opening 51 and/or 13, contrary to the direction of insertion. Thus a safe electric contact and/or a safe electric connection is created and a safe anchoring of the branch conduit 15 in the opening of clamping element 11 and/or 25 is guaranteed.

The present invention is not limited to the embodiments described. Depending on the requirement, e.g. more clamping elements may be provided, e.g. in case of electric mains with more than four wires. In the example depicted the contact element 39 has two openings 51. If the connection terminal is used for only one branch conduit, it is however sufficient to provide quasi half of the contact element 39, i.e. only one opening 51 is provided.

Furthermore the design and the number of rings 57 may be variable. E.g. polygonal internal recesses of the rings could be provided, and the fixation and contact effect of one spring element 57 may be already sufficient to fix the relevant branch conduit in the contact element safely and to guarantee the electric connection.

Thus, as an advantage, a particularly simple, space-saving and universally usable design of a connection terminal and of a contact element is provided, adabtable to the most varied applications by easily feasible, minor design changes.

I claim:

1. A connection terminal for connecting branch conduits to electrical mains of a ground lead having an insulation layer, the connection terminal comprising:

at least two clamping elements capable of attaching to an electric main and surrounding the electric main;

at least one contact element for establishing an electric contact between the main and a branch conduit, the contact element having at least one opening for receiving the branch conduit wherein the contact element having dentiform contacts to penetrate the insulation layer thereby electrically connecting the contact element to the electric main, and at least one clamping device for clamping the clamping elements to each other and to electric main in a safe position;

the contact element further having at least one spring element including spring devices capable of being deformed by the branch conduit during insertion, wherein the spring devices include at least one bendable tongue that engages into the branch conduit, thereby retaining the branch conduit in a position and establishing an electric contact between the contact element and the branch conduit.

2. The connection terminal of claim 1 wherein the contact element has at least two spring elements, the elements accommodating branch conduits of various cross-sections.

3. The connection terminal of claim 1 wherein the dentiform contacts are arrayed in rows which lie side by side.

4. The connection terminal of claim 1 wherein the contact element has at least two spring elements, the spring elements being essentially identical and arrayed at short distances to each other or adjacent to one another in the opening of the contact element, the spring elements thereby forming a set.

5. The connection terminal of claim 1 wherein the contact element has at least two spring element sets at a distance from each other, each spring element set accommodating a predetermined cross-section.

6. The connection terminal of claim 1 wherein the spring element is in the shape of a ring.

7. The connection terminal of claim 6 wherein the spring element is provided with notches, the notches originating from an interior border of the ring-shaped spring element and extending in the direction of an outside border of the spring element, one of the spring devices being located between two adjacent notches.

8. The connection terminal of claim 1 wherein the contact element has two openings for receiving two branch conduits.

9. The connection terminal of claim 8 wherein the axes of the openings coincide.

10. The connection terminal of claim 8 wherein a separation wall is provided between the openings.

11. The connection terminal of claim 1 wherein the clamping device is a pipe clamp.

12. The connection terminal of claim 11 wherein the pipe clamp is a band having a screw-shaped tightening element.

13. The connection terminal of claim 12 wherein the screw of the screw-shaped tightening element is a tear-off cap screw.

14. A connection terminal for connecting branch conduits to electrical mains of a ground lead having an insulation layer, the connection terminal comprising:

at least two clamping elements capable of attaching to an electric main and surrounding the electric main, and wherein the clamping elements having the shape of a circular arc segment and having at least one hollow section that opens towards the electric main and an opening to receive the branch conduit;

at least one contact element for establishing an electric contact between the main and a branch conduit wherein the contact element is received in the hollow section and having an opening for the branch conduit to connect to the contact element and the opening of the contact element has an axis coinciding with the axis of the clamping element's opening, and at least one clamping device for clamping the clamping elements to each other and to the electric main in a safe position.

15. The connection terminal of claim 14 having four identical clamping elements.

16. The connection terminal of claim 14 having three identical clamping elements and one different, smaller clamping element.

17. The connection terminal of claim 14 wherein a sealing agent is provided for sealing the contact point between the contact element and the electric main, the sealing agent having the form of a sealing band extending between an inner side of the contact element and the electric main.

18. The connection terminal of claim 14 wherein each clamping element is a ribbed body provided with deepenings accessible from outside.

19. The connection terminal of claim 18 wherein each clamping body has a wedge projecting in the direction of the electric main.

20. The connection terminal of claim 19 wherein the wedge is subdivided into at least two partial wedges located at a certain distance from each other.

21. The connection terminal of claim 14 wherein each clamping element has at least on projecting areas tapering in cross-section and extending from face sides of the clamping element.

22. The connection terminal of claim 21 wherein the projecting areas are integral with the clamping element.

23. The connection terminal of claim 14 wherein a cross-section in a longitudinal direction of each clamping element includes a first area parallel to the electric main wherein the hollow section is arranged and two wedges extending from the first area to the electric main.

24. The connection terminal of claim 23 wherein the wedges are integral with the first area of the clamping elements.

* * * * *